US011359794B2

(12) United States Patent
Rodriguez

(10) Patent No.: US 11,359,794 B2
(45) Date of Patent: Jun. 14, 2022

(54) SELECTABLE LIGHTING INTENSITY AND COLOR TEMPERATURE USING LUMINAIRE LENS

(71) Applicant: ABL IP Holding LLC, Atlanta, GA (US)

(72) Inventor: Yan Rodriguez, Suwanee, GA (US)

(73) Assignee: ABL IP HOLDING LLC, Atlanta, GA (US)

( * ) Notice: Subject to any disclaimer, the term of this patent is extended or adjusted under 35 U.S.C. 154(b) by 0 days.

(21) Appl. No.: 17/071,108

(22) Filed: Oct. 15, 2020

(65) Prior Publication Data

US 2021/0116102 A1 Apr. 22, 2021

Related U.S. Application Data

(60) Provisional application No. 62/916,422, filed on Oct. 17, 2019.

(51) Int. Cl.
*F21V 9/40* (2018.01)
*H05B 47/10* (2020.01)
(Continued)

(52) U.S. Cl.
CPC ..... *F21V 9/40* (2018.02); *F21S 10/026* (2013.01); *H05B 45/10* (2020.01); *H05B 45/20* (2020.01); *H05B 47/10* (2020.01); *H05B 47/11* (2020.01)

(58) Field of Classification Search
CPC ..... H05B 45/10; H05B 45/20; H05B 47/10; H05B 47/11; F21S 10/026; F21V 9/40
See application file for complete search history.

(56) References Cited

U.S. PATENT DOCUMENTS 6,201,351 B1 3/2001 Rudolph et al.
6,323,598 B1 11/2001 Guthrie et al.
(Continued)

FOREIGN PATENT DOCUMENTS

CN 106555981 4/2017
EP 2768283 8/2014
(Continued)

OTHER PUBLICATIONS

"2×4 LED Flat Panel", Cybertech, Main Place Lighting, Available Online At: https://shopmainplacelighting.com/collections/commercial-lighting/products/2-x-4-led-flat-panel-1, Accessed from Internet on May 14, 2019, 3 pages.
(Continued)

*Primary Examiner* — Abdullah A Riyami
*Assistant Examiner* — Syed M Kaiser
(74) *Attorney, Agent, or Firm* — Kilpatrick Townsend & Stockton LLP

(57) ABSTRACT

A lighting system includes a lighting device within a luminaire that generates a controllable light output. The lighting system also includes an input device within the luminaire. The input device includes a first selection mechanism communicatively coupled to the lighting device. The first selection mechanism receives a first input to transition the lighting system between a set of control states. The input device also includes a second selection mechanism communicatively coupled to the lighting device. The second selection mechanism receives a first rotational input to control a light intensity output of the lighting device or a correlated color temperature of the lighting device.

17 Claims, 5 Drawing Sheets

(51) Int. Cl.

| | |
|---|---|
| ***F21S 10/02*** | (2006.01) |
| ***H05B 45/10*** | (2020.01) |
| ***H05B 45/20*** | (2020.01) |
| ***H05B 47/11*** | (2020.01) |

(56) References Cited

U.S. PATENT DOCUMENTS 6,995,355 B2 2/2006 Rains, Jr. et al.
7,014,336 B1 3/2006 Ducharme et al.
7,088,059 B2 8/2006 McKinney et al.
7,135,664 B2 11/2006 Vornsand et al.
7,173,383 B2 2/2007 Vornsand et al.
7,329,998 B2 2/2008 Jungwirth
7,416,312 B1 8/2008 McDermott
7,423,387 B2 9/2008 Robinson et al.
7,497,590 B2 3/2009 Rains, Jr. et al.
7,520,634 B2 4/2009 Ducharme et al.
7,883,239 B2 2/2011 Rains, Jr. et al.
8,172,415 B2 5/2012 Wegh et al.
8,203,260 B2 6/2012 Li et al.
8,228,002 B2 7/2012 Newman, Jr. et al.
RE43,606 E 8/2012 Bruwer
8,317,362 B2 11/2012 Ku et al.
8,373,362 B2 2/2013 Chemel et al.
8,436,549 B2 5/2013 Hasnain
8,598,809 B2 12/2013 Negley et al.
8,633,650 B2 1/2014 Sauerlaender
8,638,045 B2 1/2014 Kunst et al.
8,669,722 B2 3/2014 Yeh et al.
8,710,754 B2 4/2014 Baddela et al.
8,791,642 B2 7/2014 van de Ven et al.
8,823,289 B2 9/2014 Linz et al.
8,872,438 B2 10/2014 Zhou et al.
8,878,443 B2 11/2014 Luo et al.
8,890,419 B2 11/2014 Stack
8,890,436 B2 11/2014 Chou
8,914,312 B2 12/2014 McLaughlin et al.
8,941,312 B2 1/2015 McRae
8,975,823 B2 3/2015 Yang et al.
9,055,647 B2 6/2015 Sutardja et al.
9,072,149 B2 6/2015 Wu et al.
9,125,271 B2 9/2015 Martins et al.
9,144,131 B2 9/2015 Wray
9,210,760 B2 12/2015 Sanders et al.
9,277,607 B2 3/2016 Ramer et al.
9,289,269 B2 3/2016 Valteau et al.
9,301,359 B2 3/2016 Wray
9,374,876 B2 6/2016 Alpert et al.
9,386,653 B2 7/2016 Kuo et al.
9,414,457 B2 8/2016 Fukuda et al.
9,485,826 B2 11/2016 Bohler et al.
9,538,603 B2 1/2017 Shearer et al.
9,538,604 B2 1/2017 Yadav et al.
9,544,951 B1 1/2017 O'Neil et al.
9,544,969 B2 1/2017 Baddela et al.
9,554,441 B2 1/2017 Sutardja et al.
9,560,710 B2 1/2017 Beijer et al.
9,603,213 B1 3/2017 Suttles et al.
9,665,262 B2 5/2017 Hole
9,719,642 B1 8/2017 Macias
9,730,291 B1 8/2017 Janik et al.
9,801,250 B1 10/2017 Halliwell
9,820,350 B2 11/2017 Pyshos et al.
9,892,693 B1 2/2018 Kumar et al.
9,900,945 B1 2/2018 Janik et al.
10,091,855 B2 10/2018 Van Winkle
10,117,300 B2 10/2018 Doheny et al.
10,163,405 B2 12/2018 Kumar et al.
10,290,265 B2 5/2019 Kumar et al.
10,292,233 B1 5/2019 Udavant et al.
10,299,335 B2 5/2019 Pyshos et al.
10,299,336 B2 5/2019 Bowen et al.
10,299,337 B1 5/2019 Chen et al.
10,448,471 B1 10/2019 Chowdhury et al.
10,575,380 B2 2/2020 Udavant et al.
10,660,174 B2 5/2020 Huang et al.
10,674,579 B2 6/2020 Bruckner et al.
10,681,784 B2 6/2020 Bruckner et al.
10,856,384 B2 12/2020 Chen et al.
10,874,006 B1 12/2020 Davis et al.
10,904,970 B2 1/2021 Udavant et al.
10,952,292 B2 3/2021 Chowdhury et al.
10,966,306 B1 * 3/2021 Recker ..... H02J 13/00006
11,026,307 B2 6/2021 Rodriguez
2005/0162851 A1 7/2005 Kazar et al.
2005/0243022 A1 11/2005 Negru
2006/0220586 A1 10/2006 Latham
2006/0226795 A1 10/2006 Walter et al.
2006/0238136 A1 10/2006 Johnson, III et al.
2006/0285310 A1 12/2006 Shyu
2007/0159750 A1 7/2007 Peker et al.
2007/0262724 A1 11/2007 Mednik et al.
2008/0130298 A1 6/2008 Negley et al.
2009/0026913 A1 1/2009 Mrakovich
2009/0218960 A1 9/2009 Lyons et al.
2009/0256483 A1 10/2009 Gehman et al.
2010/0097406 A1 4/2010 Zulch
2010/0141175 A1 6/2010 Hasnain et al.
2010/0171633 A1 7/2010 Baker et al.
2010/0207534 A1 8/2010 Dowling et al.
2010/0214764 A1 8/2010 Chaves et al.
2010/0283322 A1 11/2010 Wibben
2010/0308738 A1 12/2010 Shteynberg et al.
2011/0058372 A1 3/2011 Lerman et al.
2011/0062872 A1 3/2011 Jin et al.
2011/0068702 A1 3/2011 van de Ven et al.
2011/0084615 A1 4/2011 Welten
2011/0115407 A1 5/2011 Wibben et al.
2011/0210678 A1 9/2011 Grajcar
2011/0273495 A1 11/2011 Ward et al.
2011/0316441 A1 12/2011 Huynh
2012/0080944 A1 4/2012 Recker et al.
2012/0081005 A1 * 4/2012 Lin ..... G02B 6/0076 315/86
2012/0081009 A1 4/2012 Shteynberg et al.
2012/0098460 A1 4/2012 Miyasaka et al.
2012/0242247 A1 9/2012 Hartmann et al.
2012/0253542 A1 10/2012 Nurmi et al.
2012/0286753 A1 11/2012 Zhong et al.
2013/0002167 A1 1/2013 Van de Ven
2013/0021580 A1 1/2013 Morgan et al.
2013/0038222 A1 2/2013 Yeh et al.
2013/0043795 A1 * 2/2013 Burayez ..... H05B 47/195 315/150
2013/0049610 A1 2/2013 Chen
2013/0082616 A1 4/2013 Bradford et al.
2013/0140988 A1 6/2013 Maxik et al.
2013/0141013 A1 6/2013 Kodama et al.
2013/0169158 A1 7/2013 He et al.
2013/0200806 A1 8/2013 Chobot
2013/0229125 A1 9/2013 Yan et al.
2013/0249422 A1 9/2013 Kerstens et al.
2013/0249440 A1 9/2013 Doshi et al.
2013/0343052 A1 12/2013 Yen
2014/0001959 A1 1/2014 Motley et al.
2014/0035472 A1 2/2014 Raj et al.
2014/0042920 A1 2/2014 Chou
2014/0184076 A1 7/2014 Murphy
2014/0197750 A1 7/2014 Cash
2014/0210357 A1 7/2014 Yan et al.
2014/0210364 A1 7/2014 Cash et al.
2014/0252967 A1 9/2014 Van de Ven et al.
2014/0312777 A1 10/2014 Shearer et al.
2015/0009666 A1 1/2015 Keng et al.
2015/0097489 A1 4/2015 Wu et al.
2015/0245441 A1 8/2015 McCune, Jr.
2015/0256760 A1 9/2015 Ju et al.
2015/0351169 A1 12/2015 Pope et al.
2015/0359061 A1 12/2015 Adler
2016/0007420 A1 1/2016 Gong et al.
2016/0098950 A1 4/2016 Nicholson
2016/0128155 A1 5/2016 Petluri et al.
2016/0323949 A1 11/2016 Lee
2016/0352975 A1 12/2016 Kervec et al.

(56) References Cited

U.S. PATENT DOCUMENTS

| | | | | |
|---|---|---|---|---|
| 2016/0363308 | A1 | 12/2016 | Shum | |
| 2016/0366746 | A1 | 12/2016 | Van de Ven et al. | |
| 2016/0374177 | A1 | 12/2016 | Chen | |
| 2017/0019973 | A1 | 1/2017 | Beck et al. | |
| 2017/0027033 | A1 | 1/2017 | Chobot et al. | |
| 2017/0086265 | A1 | 3/2017 | Akiyama et al. | |
| 2017/0086280 | A1 | 3/2017 | Boomgaarden et al. | |
| 2017/0135186 | A1 | 5/2017 | O'Neil et al. | |
| 2017/0164440 | A1 | 6/2017 | Hu et al. | |
| 2017/0238392 | A1 | 8/2017 | Shearer et al. | |
| 2017/0354013 | A1 | 12/2017 | DeMayo et al. | |
| 2018/0035510 | A1 | 2/2018 | Doheny et al. | |
| 2018/0103523 | A1 | 4/2018 | Yan et al. | |
| 2018/0116029 | A1 | 4/2018 | Pyshos et al. | |
| 2018/0166026 | A1 | 6/2018 | Kumar et al. | |
| 2018/0242422 | A1 | 8/2018 | Choi et al. | |
| 2018/0249547 | A1 | 8/2018 | Wang et al. | |
| 2018/0310381 | A1 | 10/2018 | Bowen et al. | |
| 2018/0368218 | A1 | 12/2018 | Petluri et al. | |
| 2018/0368232 | A1 | 12/2018 | Doheny et al. | |
| 2019/0027099 | A1 | 1/2019 | Kumar et al. | |
| 2019/0037663 | A1 | 1/2019 | Van Winkle | |
| 2019/0088213 | A1 | 3/2019 | Kumar et al. | |
| 2019/0090327 | A1* | 3/2019 | Zolotykh | H05B 47/19 |
| 2019/0141812 | A1 | 5/2019 | Chen | |
| 2019/0191512 | A1 | 6/2019 | Zeng et al. | |
| 2019/0268984 | A1 | 8/2019 | Song et al. | |
| 2019/0268991 | A1 | 8/2019 | Li | |
| 2019/0394851 | A1 | 12/2019 | Sinphay | |

FOREIGN PATENT DOCUMENTS

| | | |
|---|---|---|
| EP | 2728972 | 8/2015 |
| JP | 2011258517 | 12/2011 |
| WO | 2011084135 | 7/2011 |

OTHER PUBLICATIONS

"3 Inch WarmDim/Tunable White", Aculux, Accessed from Internet on May 15, 2020, 3 pages.

"38W Led Panel—Color Selectable", Venture Lighting, Available Online At: https://www.venturelighting.com/led-lighting/indoor-lighting-fixtures/panels-and-troffers/color-selectable-panels/standard-product/pn38592.html, Accessed from Internet on May 14, 2019, 6 pages.

"Easy Lighting Control", Application Guide, OSRAM, Available Online At: www.osram.com/easy, Apr. 2015, 25 pages.

"Human Centric Lighting", Helvar, Intelligent Colour Product Series, Available Online At: helvar.com/second-sun, Dec. 4, 2017, 4 pages.

"IW Cove MX Powercore-Premium Interior Linear LED Cove and Accent Luminaire with Intelligent White Light", Philips Lighting, Product Family Leafelet, Jan. 21, 2019, 3 pages.

"LED Panel 1230 40W Colour Changeable", Fuzion Lighting, Information sheet, Available online At: http://www.fuzionlighting.com.au/product/led-panel-40-cct, Accessed from Internet on Mar. 19, 2019, 6 pages.

"LED Universal Ceiling Fan Light Kit", Hampton Bay, Use and Care Guide, Nov. 7, 2019, 22 pages.

"LLP LED Light Panel", Main Place Lighting, Specification Sheet, Available Online At: https://cdn.shopify.com/s/files/1/2048/2207/files/LLP-Specification-Sheet-1.pdf, Accessed from Internet on Mar. 19, 2019, 4 pages.

"Noble Pro LED Line Voltage Task Lighting NLLP Series", AFX, Available Online At: www.AFXinc.com, Accessed from Internet at May 13, 2019, 1 page.

"Par Lite Led", VariWhite, Coemar, User Manual Version 1.0, Jun. 2011, 19 pages.

"ViaCon LED-Products", Trilux Simplify your Light, Available Online At: https://www.trilux.com/en/products/viacon-led/, Accessed from Internet on May 13, 2019, 11 pages.

"Warmdim® & Tunable White Adjustable/downlight/wall Wash 1000 Lumen Led 3" Baffle Down Light Trim AX3 WDTW with 3DBAF Trim, Aculux Luminaire, Mar. 20, 2019, 3 pages.

6" IC LED Retrofit Warmdim (TM) Downlight Trim, Juno, Oct. 2012, 2 pages.

Biery et al., Controlling LEDs, Lutron Electronics Corporation Incorporated, May 2014, 20 pages.

Sun, Challenges and Opportunities for High Power White LED Development, DOE SSL R&D Workshop, Feb. 1, 2012, pp. 1-12.

* cited by examiner

SELECTABLE LIGHTING INTENSITY AND COLOR TEMPERATURE USING LUMINAIRE LENS

CROSS-REFERENCE TO RELATED APPLICATION

This claims the benefit to U.S. Provisional Application No. 62/916,422 filed on Oct. 17, 2019, titled "SELECTABLE LIGHTING INTENSITY AND COLOR TEMPERATURE USING LUMINAIRE LENS," the disclosure of which is hereby incorporated by reference in its entirety for all purposes.

TECHNICAL FIELD

Embodiments of the presently disclosed subject matter relate to light fixtures with selectable lighting intensity and color temperature outputs. In particular, the presently disclosed subject matter relates to a luminaire that selects lighting intensity, color temperature, or both using mechanical input from a lens of the luminaire.

BACKGROUND

Control of a luminaire is often provided using switches, chains, slider bars, or other actuating mechanisms that are located on an external surface of the luminaire. When providing selection mechanisms capable of controlling multiple light features (e.g., on/off, light intensity, correlated color temperature (CCT), etc.), external surfaces of the luminaire may become cluttered with the selection mechanisms. Other luminaires provide selection mechanisms in "hidden" locations when the luminaire is installed. Such an arrangement prevents the ability to adjust light features after the luminaire has been installed (e.g., for a downlight or a ceiling mounted light). To avoid external surface clutter, to increase usability, and to enable light output adjustments after the luminaire is installed, alternative selection mechanisms for the luminaire are desired.

SUMMARY

Certain aspects involve lighting control systems that enable control of luminaire operations. For instance, a lighting system includes a lighting device within a luminaire that generates a controllable light output. The lighting system also includes an input device within the luminaire. The input device includes a first selection mechanism communicatively coupled to the lighting device. The first selection mechanism receives a first input to transition the lighting system between a set of control states. The input device also includes a second selection mechanism communicatively coupled to the lighting device. The second selection mechanism receives a first rotational input to control a light intensity output of the lighting device or a correlated color temperature of the lighting device.

In an additional example, an input device includes a first selection mechanism positionable within a luminaire to communicatively couple to a lighting device of the luminaire. The first selection mechanism receives a first input to transition the lighting device from a first control state to a second control state. Additionally, the input device includes a second selection mechanism positionable within the luminaire to communicatively couple to the lighting device of the luminaire. The second selection mechanism receives a first rotational input to control a light intensity output of the lighting device or a correlated color temperature of the lighting device associated with the second control state.

In an additional example, a method includes receiving a first input from a first selection mechanism at a luminaire of a lighting system to transition from a first lighting control state to a second lighting control state. The method also includes receiving a second input from a rotational input mechanism at a luminaire of the lighting system to adjust a light output of the lighting system in the second lighting control state. Further, the method includes controlling a light intensity output or a correlated color temperature output of the lighting system using the second input from the rotational input mechanism.

These illustrative aspects are mentioned not to limit or define the disclosure, but to provide examples to aid understanding thereof. Additional aspects are discussed in the Detailed Description, and further description is provided there.

BRIEF DESCRIPTION OF THE DRAWINGS

Features, aspects, and advantages of the present disclosure are better understood when the following Detailed Description is read with reference to the accompanying drawings.

DETAILED DESCRIPTION

The present disclosure relates to systems that that enable control of luminaire operations using interactive user interfaces. As explained above, devices currently used to control certain types of connected lighting systems may suffer from accessibility issues. As a result, access to control of the connected lighting system may be limited.

The subject matter of the presently disclosed embodiments is described herein with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The presently disclosed subject matter includes a luminaire with an internal light output selection mechanism. For example, the luminaire may include a mechanism capable of selecting a correlated color temperature (CCT), a light intensity, an "on" or "off" state, or a combination thereof using a depression of a lens diffuser of the luminaire, using a rotation of a portion of the luminaire, or using a combination of lens diffuser depression and rotation. For example, upon depressing a lens diffuser of a luminaire, the luminaire may enter an "on" state (e.g., generating light output) from an "off" state (e.g., not generating light output) or an "off" state from an "on" state. In another example, depressing the lens diffuser may change a light intensity output of the luminaire, or depressing the lens diffuser may change a CCT of the light output of the luminaire.

In another example, the light intensity, the CCT, or both of the luminaire may be adjusted by rotating the lens diffuser in a clockwise or counterclockwise direction. For example, the lens diffuser may rotate freely within a lens housing, and a rotation tracker may adjust the light intensity or CCT based on a detection of how much the lens diffuser has rotated. In an additional example, a cone reflector (e.g., within a downlight) may also be rotatable to control output of the light intensity or the CCT of the luminaire.

Figure 1:
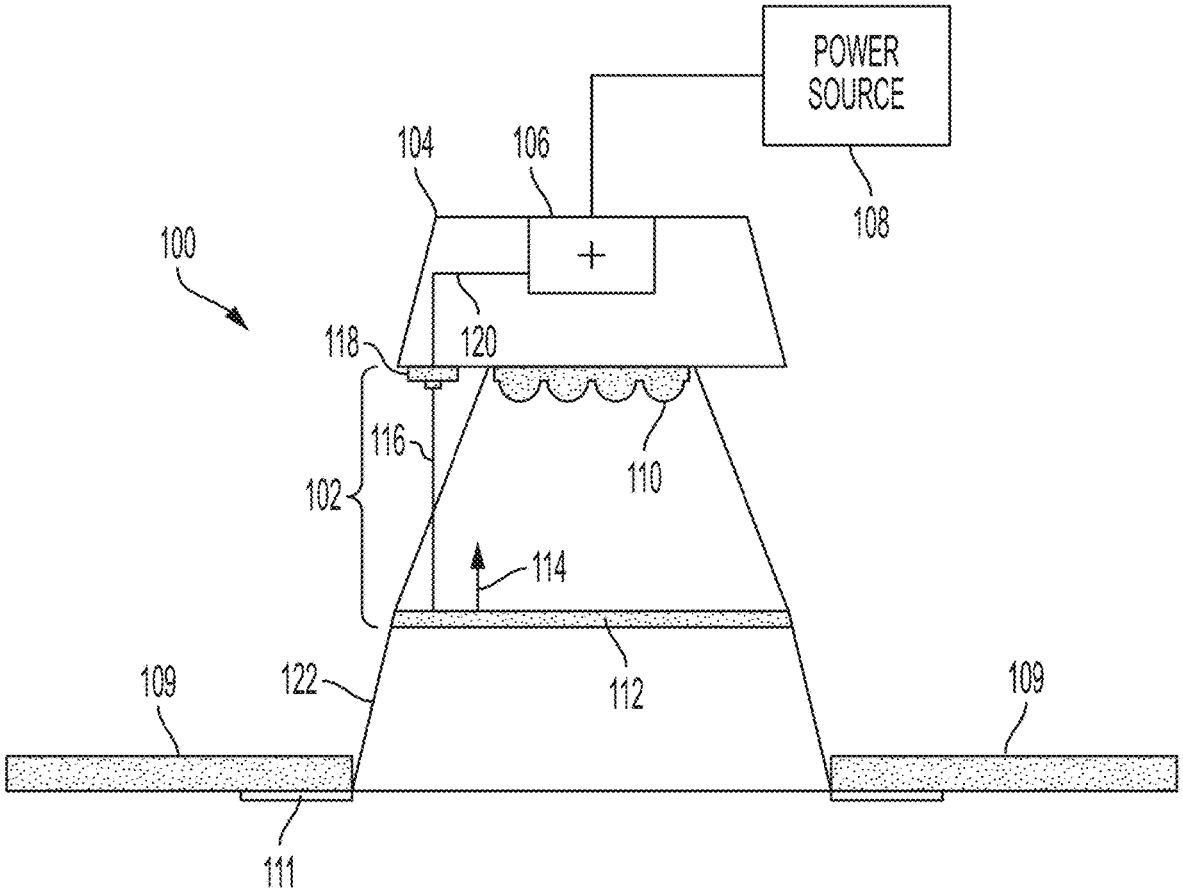
FIG. 1 depicts a sectional schematic view of a luminaire including a lens diffuser selection mechanism, according to certain aspects of the present disclosure.

FIG. 1 is a sectional schematic view of a luminaire 100 including a lens diffuser selection mechanism 102. The luminaire 100 includes a housing 104 with a controller 106. The controller 106 may be coupled to an external or internal power source 108, and the controller 106 provides control signals to one or more lighting devices 110 (e.g., light emitting diodes or other light sources). The luminaire 100 may be installed within a ceiling 109, and a flange 111 of the luminaire 100 may be positioned flush with the ceiling 109 such that gaps are avoided between the luminaire 100 and a hole in the ceiling 109 in which the luminaire 100 is positioned.

In an example, the controller 106 controls the light intensity and the CCT of the lighting devices 110 based on a user interaction with the lens diffuser selection mechanism 102. The lens diffuser selection mechanism 102 may include a lens diffuser 112 that diffuses light from the lighting devices 110. In an example, a user may depress a lens diffuser 112 toward the lighting devices 110. Depression of the lens diffuser 112 exerts a force in a direction 114 on a selection rod 116 or other actuation device. The selection rod 116 may depress or otherwise interact with a switching mechanism 118. Based on the interaction between the selection rod 116 and the switching mechanism 118, a control signal is provided along a control line 120 to the controller 106 to control the light output of the lighting devices 110. Other components of the luminaire 100 may also be used to provide the force in the direction 114 on the selection rod 116. For example, a cone reflector 122 may be depressed to interact with a selection rod 116 of the switching mechanism 118.

As discussed above, the depression of the lens diffuser 112 may cause the controller 106 to control the lighting devices 110 in several different ways. For example, each depression of the lens diffuser 112 may result in the transition of the lighting devices 110 from an "off" state to an "on" state or from an "on" state to an "off" state. In another example, each depression of the lens diffuser 112 may cycle through available light intensities for the lighting devices 110. For example, a first depression of the lens diffuser 112 may provide an output light intensity of 100%, a second depression of the lens diffuser 112 may provide an output light intensity of 75%, a third depression of the lens diffuser 112 may provide an output light intensity of 50%, and so on. Other transitions between output light intensities are also contemplated. In another example, each depression of the lens diffuser 112 may cycle through available CCTs of the lighting devices 110. For example, a first depression of the lens diffuser 112 may provide an output CCT that appears "warm," while a second depression of the lens diffuser 112 may transition the output CCT to appear "cool." Other output CCT transitions are also contemplated.

In another example, the depression of the lens diffuser 112 may send a control signal along the control line 120 to the controller 106 to transition the control mode of the lighting devices 110. For example, a first depression of the lens diffuser 112 may transition the lighting devices 110 to an "on" state from an "off" state. A second depression of the lens diffuser 112 may transition the lighting devices 110 into a light intensity control mode. While the lighting devices 110 are in a light intensity control mode, the lens diffuser 112 may be rotated (e.g., clockwise or counterclockwise) to provide control signals to the controller 106 that control the light intensity of the lighting devices 110. For example, as the lens diffuser 112 rotates in a clockwise direction, the light intensity of the lighting devices 110 may increase. Similarly, as the lens diffuser 112 rotates in a counterclockwise direction, the light intensity of the lighting devices 110 may decrease.

A third depression of the lens diffuser 112 may transition the lighting devices 110 into a CCT control mode. While the lighting devices 110 are in the CCT control mode, the lens diffuser 112 may be rotated to provide control signals to the controller 106 to control the CCT output by the lighting devices 110. For example, as the lens diffuser 112 rotates in a clockwise direction, the CCT may gradually transition from a warmer color temperature to a colder color temperature. Similarly, as the lens diffuser 112 rotates in a counterclockwise direction, the CCT may gradually transition from a cooler color temperature to a warmer color temperature. Further, a fourth depression of the lens diffuser 112 may transition the lighting devices 110 from the "on" state to the "off" state.

The lighting devices 110 may also be controlled by depressing the lens diffuser 112 in different manners. For example, depressing the lens diffuser 112 with a "long" press (e.g., where the lens diffuser 112 is depressed for more than 1 second) may transition the lighting devices into one control mode (e.g., a CCT control mode or a light intensity control mode). Additionally, depressing the lens diffuser 112 with a "short" press (e.g., where the lens diffuser 112 is depressed for less than or equal to 1 second) may transition the lighting devices into the other control mode. Further, a series of "long" presses may control the lighting devices 110 in a manner different from a series of "short" presses. For example, three "long" presses may cycle through color temperature settings, while three "short" presses may cycle through light intensity settings. In another example, combinations of "long" and "short" presses may change the control mode of the lighting devices 110. For example, each control mode may be accessed by a unique combination of the "long" and "short" presses on the lens diffuser 112.

In another example, the rotational control of the lighting devices 110 may be provided by rotating a cone reflector 122 of the luminaire 100. For example, the cone reflector 122 may be rotated in place of the lens diffuser 112 or in addition to the lens diffuser 112. For example, upon depressing the lens diffuser 112 to transition the lighting devices 110 from the "off" state to the "on" state, the lens diffuser 112 may be rotated to control the light intensity of the lighting devices 110, while the cone reflector 122 may be rotated to control the CCT of the lighting devices 110. In another example, the lens diffuser 112 is rotated to control the CCT of the lighting devices 110, while the cone reflector 112 is rotated to control the light intensity of the lighting devices 110. Any other characteristics of the lighting devices 110 may also be controlled by the depression of the lens diffuser 112, rotation of the lens diffuser 112 or other component of the luminaire 100, or any combination thereof.

In another example, the depression of the lens diffuser 112 may cycle through light intensities of the lighting devices 110, while rotation of the lens diffuser 112 or the cone reflector 122 provides control of the CCT of the lighting devices 110. Similarly, the depression of the lens diffuser 112 may cycle through CCT settings of the lighting devices 110, while the rotation of the lens diffuser 112 provides control of the light intensity of the lighting devices 110.

While the rotational control is generally described herein as being provided by rotational movement of the lens diffuser 112 or cone reflector 122, other components of the luminaire 100 may also be rotated to control the output of the lighting devices 110. For example, the flange 111 may also be rotated to provide control of CCT, light intensity, or both of the lighting devices 110. Further, other control mechanisms may be incorporated into the luminaire 100. For example, a sliding bar may be installed within the luminaire 100 to provide control of one or more of the lighting characteristics of the lighting devices 110. In an example of a linear luminaire, the lens diffuser 112 may provide a sliding movement in place of the rotational movement of the lens diffuser 112 described above.

Figure 2:
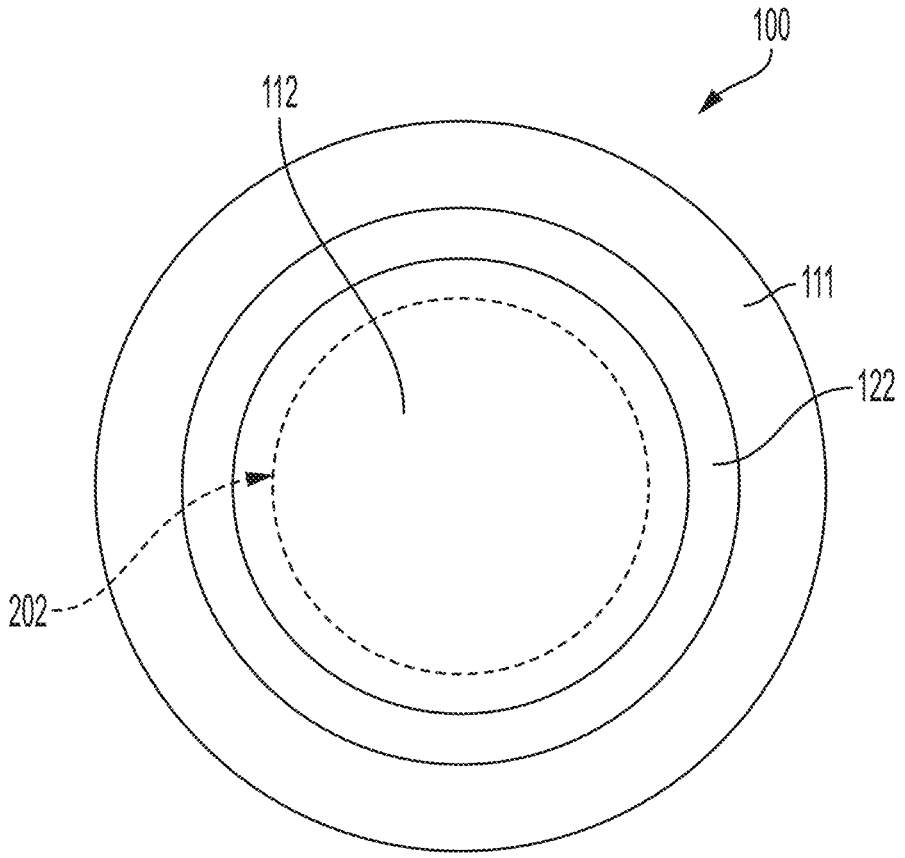
FIG. 2 depicts a schematic view of a room facing (e.g., downward facing) portion of the luminaire of FIG. 1, according to certain aspects of the present disclosure.

FIG. 2 is a schematic view of a room facing (e.g., downward facing) portion of the luminaire 100. As discussed above with respect to FIG. 1, any of the flange 111, the cone reflector 122, and the lens diffuser 112 can be rotated to control the CCT and light intensity of the lighting devices 110. Additionally, the luminaire 100 may include a bezel 202 that is rotatable around the lens diffuser 112. The bezel 202 may rotate about the lens diffuser 112 to control characteristics of the lighting devices 110 while the lens diffuser 112 remains stationary. Other lighting control mechanisms may also be installed with the luminaire 100 to control lighting characteristics of the lighting devices 110.

Figure 3:
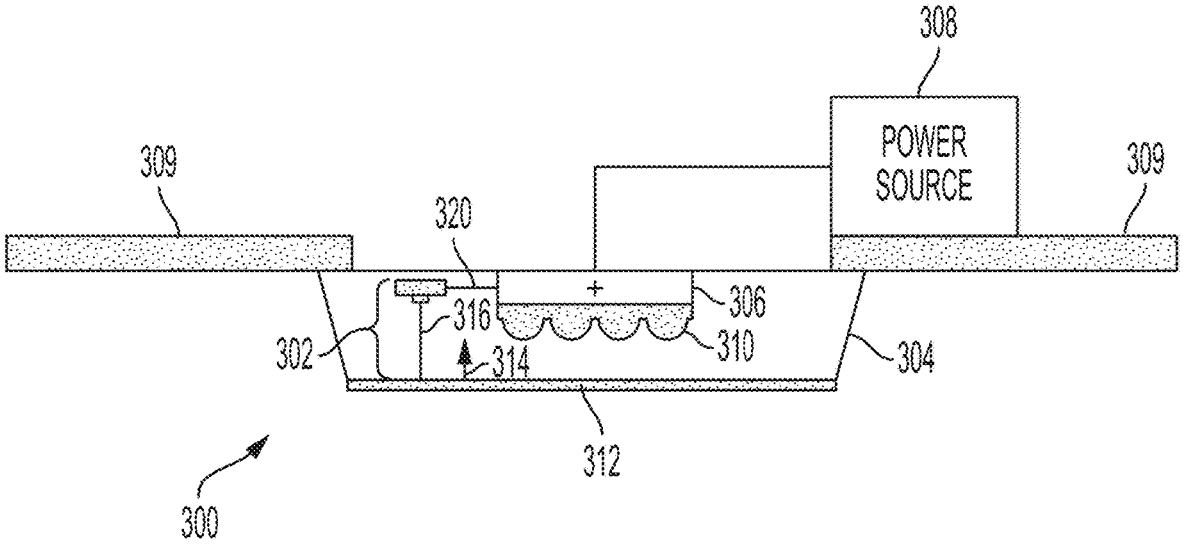
FIG. 3 depicts a sectional schematic view of a luminaire that extends below a ceiling and includes a lens diffuser selection mechanism, according to certain aspects of the present disclosure.

FIG. 3 is a sectional schematic view of a luminaire 300 that extends below a ceiling 309 and includes a lens diffuser selection mechanism 302. The luminaire 300 includes a housing 304 with a controller 306. The controller 306 may be coupled to an external or internal power source 308, and the controller 306 provides control signals to one or more lighting devices 310 (e.g., light emitting diodes or other light sources). The luminaire 300 may be installed within the ceiling 309.

In an example, the controller 306 controls the light intensity and the CCT of the lighting devices 310 based on a user interaction with the lens diffuser selection mechanism 302. For example, a user may depress a lens diffuser 312 toward the lighting devices 310. Depression of the lens diffuser 312 exerts a force in a direction 314 on a selection rod 316 or other actuation device. The selection rod 316 depresses or otherwise interacts with a switching mechanism 318. Based on the interaction between the selection rod 316 and the switching mechanism 318, a control signal is provided along a control line 320 to the controller 306 to control the light output of the lighting devices 310.

As discussed above, the depression of the lens diffuser 312 may cause the controller 306 to control the lighting devices 310 in several different ways. For example, each depression of the lens diffuser 312 may result in the transition of the lighting devices 310 from an "off" state to an "on" state or from an "on" state to an "off" state. In another example, each depression of the lens diffuser 312 may cycle through available light intensities for the lighting devices 310. For example, a first depression of the lens diffuser 312 may provide an output light intensity of 100%, a second depression of the lens diffuser 312 may provide an output light intensity of 75%, a third depression of the lens diffuser 312 may provide an output light intensity of 50%, and so on. Other transitions between output light intensities are also contemplated.

In another example, each depression of the lens diffuser 312 may cycle through available CCTs of the lighting devices 310. For example, a first depression of the lens diffuser 312 may provide an output CCT that appears "warm," while a second depression of the lens diffuser 312 may transition the output CCT to appear "cool." Other output CCT transitions are also contemplated.

In another example, the depression of the lens diffuser 312 may send a control signal along the control line 320 to the controller 306 to transition the control mode of the lighting devices 310. For example, a first depression of the lens diffuser 312 may transition the lighting devices 310 to an "on" state from an "off" state. A second depression of the lens diffuser 312 may transition the lighting devices 310 into a light intensity control mode. While the lighting devices 310 are in the light intensity control mode, the lens diffuser 312 may be rotated to provide control signals to the controller 306 to control the light intensity of the lighting devices 310. For example, as the lens diffuser 312 rotates in a clockwise direction, the light intensity of the lighting devices 310 may increase. Similarly, as the lens diffuser 312 rotates in a counterclockwise direction, the light intensity of the lighting devices 310 may decrease.

A third depression of the lens diffuser 312 may transition the lighting devices 310 into a CCT control mode. While the lighting devices 310 are in the CCT control mode, the lens diffuser 312 may be rotated to provide control signals to the controller 306 to control the CCT output by the lighting devices 310. For example, as the lens diffuser 312 rotates in a clockwise direction, the CCT may gradually transition from a warmer color temperature to a colder color temperature. Similarly, as the lens diffuser 312 rotates in a counterclockwise direction, the CCT may gradually transition from a colder color temperature to a warmer color temperature. Further, a fourth depression of the lens diffuser 312 may transition the lighting devices 310 from the "on" state to the "off" state.

In another example, the rotational control of the lighting devices 310 may be provided by rotating the housing 304 of the luminaire 100. For example, the housing 304 may be rotated in place of the lens diffuser 312 or in addition to the lens diffuser 312. In an example, upon depressing the lens diffuser 312 to transition the lighting devices 310 from the "off" state to the "on" state, the lens diffuser 312 may be rotated to control the light intensity of the lighting devices 310, while the housing 304 may be rotated to control the CCT of the lighting devices 310. In another example, the lens diffuser 312 is rotated to control the CCT of the lighting devices 310, while the housing 304 is rotated to control the light intensity of the lighting devices 310.

In other examples, the depression of the lens diffuser 312 may cycle through light intensities of the lighting devices 310, while rotation of the lens diffuser 312 or the housing 304 provides control of the CCT of the lighting devices 310. Similarly, the depression of the lens diffuser 312 may cycle through CCT settings of the lighting devices 310, while the rotation of the lens diffuser 312 provides control of the light intensity of the lighting devices 310.

While the rotational control is generally described herein as being provided by rotational movement of the lens diffuser 312 or the housing 304, other components of the luminaire 300 may also be rotated to control the output of the lighting devices 310. For example, other control mechanisms may also be incorporated into the luminaire 300 such as a diffuser lens bezel or other rotating component capable of providing control for one or more of the lighting characteristics of the lighting devices 310.

Figure 4:
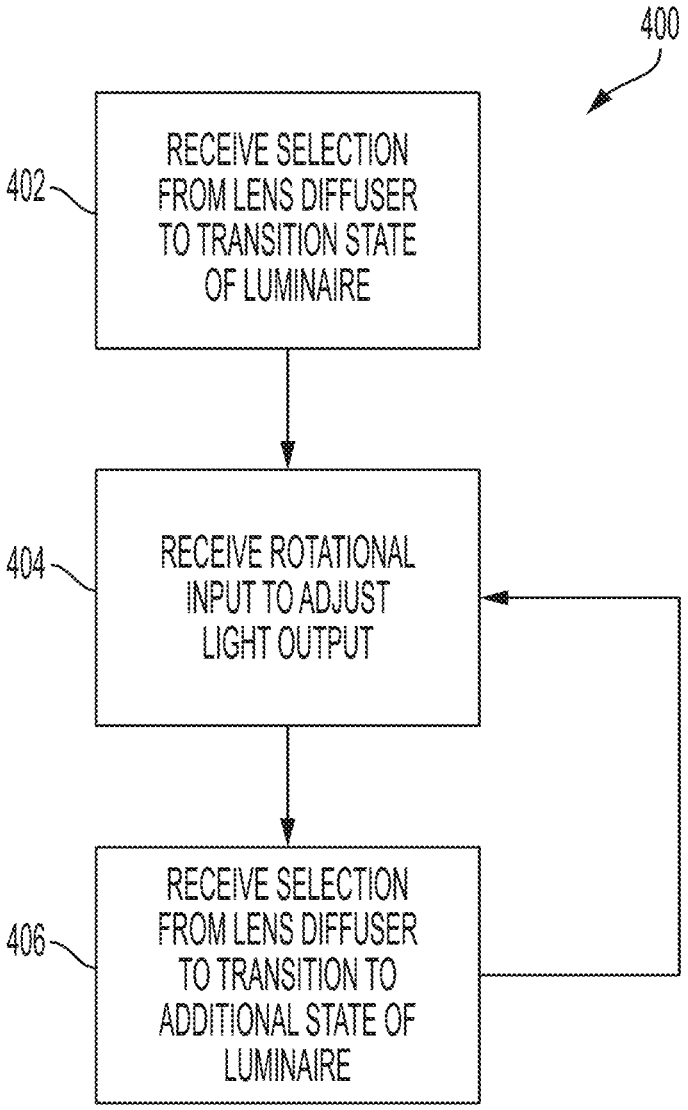
FIG. 4 depicts a flowchart of a process for controlling the luminaires of FIGS. 1 and 3 using a lens diffuser selection mechanism, according to certain aspects of the present disclosure.

FIG. 4 is a flowchart of a process 400 for controlling the luminaire 100 using a lens diffuser selection mechanism 102. While the process 400 is described with respect to the luminaire 100 depicted in FIG. 1, the process 400 may also apply to the luminaire 300 depicted in FIG. 3. At block 402, the process 400 involves receiving a selection from the lens diffuser 112 to transition a state of the luminaire. In some examples, the selection may involve a user depressing the lens diffuser 112 to transition the state of the luminaire to a correlated color temperature (CCT) control state, a light intensity control state, an "on" or "off" state, or a combination thereof.

At block 404, the process 400 involves receiving a rotational input at the luminaire 100 to adjust the lumen output or the CCT output of the luminaire 100. The rotational input may be provided by rotation of the lens diffuser 112 or any other rotational elements of the luminaire 100, as described above with respect to FIGS. 1-3. In another example, the lens diffuser 112 may be rotated to control the CCT output of the luminaire 100, while an additional rotational element of the luminaire 100 (e.g., the cone reflector 122, the bezel 202, the flange 111, the housing 304, etc.) is rotated to control the light intensity of the luminaire 100. Moreover, any combination rotational elements of the luminaire 100 may be used for controlling the CCT output and the light intensity of the luminaire 100.

At block 406, the process 400 involves receiving a selection from the lens diffuser 112 to transition the luminaire 100 to an additional state of the luminaire 100. In an example, the luminaire 100 may transition from the CCT control state to the light intensity control state. In such an example, the process 400 may return to block 404 to receive another rotational input at the luminaire 100 to control the light intensity of the luminaire 100. In an additional example, the luminaire 100 may transition to the "off" state upon receiving the selection at block 406.

Figure 5:
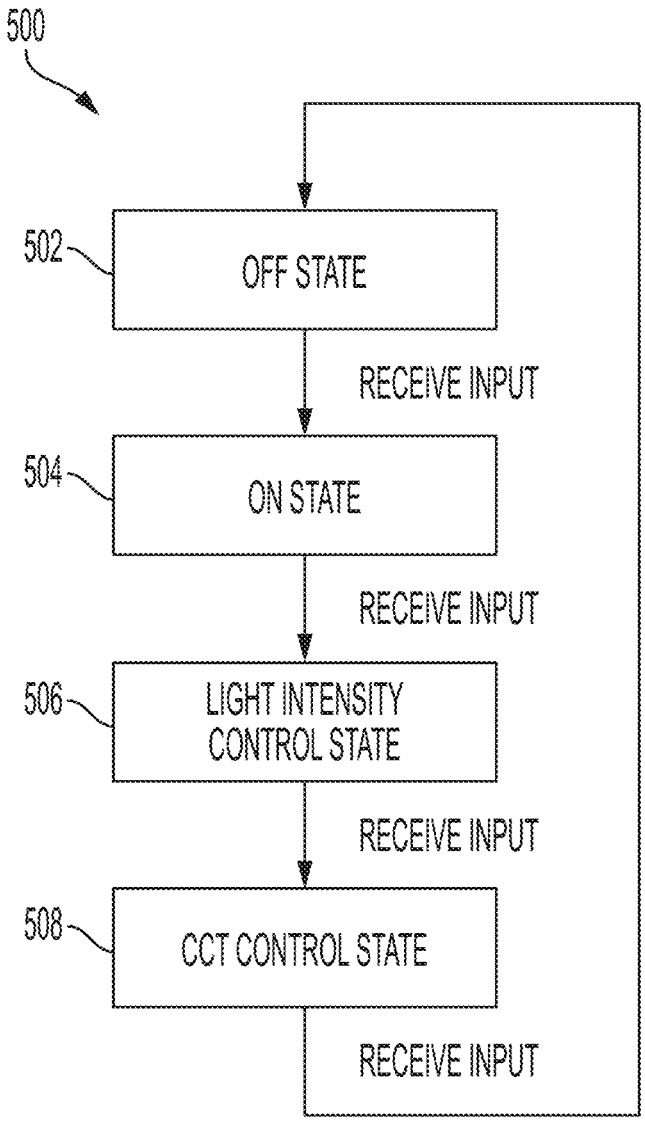
FIG. 5 depicts an example of state diagram of the luminaires of FIGS. 1 and 3, according to certain aspects of the present disclosure.

FIG. 5 depicts an example of state diagram 500 of the luminaires 100 and 300, according to certain aspects of the present disclosure. While the state diagram 500 depicts an OFF state 502 as an initial state, any of the described states may be the initial state of the luminaires 100 and 300. Further, the states depicted in the state diagram 500 may occur in any order. As shown, the OFF state 502 may be when the luminaires 100 and 300 are not generating a light output. After receiving an input from the lens diffuser selection mechanism 102, the luminaires 100 and 300 may transition to an ON state 504. The ON state 504 may be when the luminaires 100 and 300 output a light. The light output when transitioning to the ON state 504 may be a pre-determined light output (e.g., a pre-determined light intensity and CCT), or the light output may be a most recent light output prior to the luminaires 100 and 300 entering the OFF state 502.

Upon receiving another input from the lens diffuser selection mechanism 102, the luminaires 100 and 300 may transition to a light intensity control state 506. In the light intensity control state 506, the luminaires 100 and 300 may receive a rotational input from a rotational element of the luminaires 100 and 300 to control the light intensity of the light output from the luminaires 100 and 300. The rotational input in a clockwise direction may increase the light intensity, while the rotational input in the counterclockwise direction may decrease the light intensity of the luminaires 100 and 300.

Upon receiving another input from the lens diffuser selection mechanism 102, the luminaires 100 and 300 may transition to a correlated color temperature (CCT) control state 508. In the CCT control state 508, the luminaires 100 and 300 may receive a rotational input from a rotational element of the luminaires 100 and 300 to control the color temperature of the light output from the luminaires 100 and 300. The rotational input in a clockwise direction may increase the coolness of the color temperature of the light output, while the rotational input in the counterclockwise direction may increase a warmth of the color temperature of the light output of the luminaires 100 and 300. Upon receiving another input from the lens diffuser selection mechanism 102, the luminaires 100 and 300 may transition to the OFF state 502.

In an example, the transition from the OFF state 502 to the ON state 504 may transition the luminaires 100 and 300 directly to the light intensity control state 506 or the CCT control state 508 without an additional input after transitioning to the ON state 504. Further, the transitions to the light intensity control state 506 and the CCT control state 508 may occur simultaneously when the luminaires 100 and 300 have multiple rotational elements that can receive a rotational input. For example, the lens diffuser 112 can receive a rotational input to control the light intensity while the cone reflector 122 can receive a rotational input to control the CCT of the light output. That is, one rotational element may be assigned to light intensity control while another rotational element may be assigned to CCT control of the luminaires 100 and 300.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the presently disclosed subject matter.

What is claimed is:

1. A lighting system, comprising:

a lighting device within a luminaire configured to generate a controllable light output; and an input device within the luminaire, comprising:

a first selection mechanism communicatively coupled to the lighting device, wherein the first selection mechanism is configured to receive a first input to transition the lighting system between a set of control states;

a second selection mechanism communicatively coupled to the lighting device, wherein the second selection mechanism is configured to receive a first rotational input to control a light intensity output of the lighting device or a correlated color temperature of the lighting device, and a lens diffuser configured to diffuse the controllable light output of the lighting device, wherein the first input comprises a depression of the lens diffuser that is detectable by the first selection mechanism.

2. The lighting system of claim 1, wherein the first rotational input comprises a rotation of the lens diffuser that is detectable by the second selection mechanism.

3. The lighting system of claim 1, wherein the first selection mechanism is further configured to receive a second input to transition the lighting system to an additional control state of the set of control states, and wherein the second selection mechanism is further configured to receive a second rotational input to control the light intensity output of the lighting device or the correlated color temperature of the lighting device associated with the additional control state.

4. The lighting system of claim 1, further comprising:

a third selection mechanism communicatively coupled to the lighting device, wherein the third selection mechanism is configured to receive a second rotational input to control the light intensity output of the lighting device or the correlated color temperature of the lighting device.

5. The lighting system of claim 4, further comprising:

a lens diffuser configured to diffuse the controllable light output of the lighting device, wherein the first rotational input comprises a rotation of the lens diffuser; and an additional rotational element, wherein the second rotational input comprises a rotation of the additional rotational element.

6. The lighting system of claim 5, wherein the additional rotational element comprises a cone reflector, a bezel, a flange, or a housing of the lighting system.

7. The lighting system of claim 1, wherein the set of control states comprises a correlated color temperature (CCT) control state, a light intensity control state, and an "on" or "off" state of the lighting system.

8. The lighting system of claim 1, further comprising:

a lens diffuser configured to transmit the first input to the first selection mechanism, wherein the first selection mechanism comprises:

a switching mechanism; and a selection rod configured to receive the first input from the lens diffuser and to interact with the switching mechanism in response to the first input received from the lens diffuser.

9. An input device, comprising:

a first selection mechanism positionable within a luminaire and configured to communicatively couple to a lighting device of the luminaire, wherein the first selection mechanism is configured to receive a first input to transition the lighting device from a first control state to a second control state; and a second selection mechanism positionable within the luminaire configured to communicatively couple to the lighting device of the luminaire, wherein the second selection mechanism is configured to receive a first rotational input to control a light intensity output of the lighting device or a correlated color temperature of the lighting device associated with the second control state, wherein the first input comprises a depression of a lens diffuser of the lighting device.

10. The input device of claim 9, wherein the first rotational input is configured to control the light intensity output when the lighting device is in the first control state, and wherein the first rotational input is configured to control the correlated color temperature when the lighting device is in the second control state.

11. The input device of claim 9, wherein the first rotational input comprises a rotation of a lens diffuser, a cone reflector, a bezel, a flange, or a housing of the lighting device.

12. The input device of claim 9, wherein the first selection mechanism is further configured to receive a second input to transition the lighting device to a third control state, and wherein the second selection mechanism is further configured to receive a second rotational input to control the light intensity output of the lighting device or the correlated color temperature of the lighting device that is associated with the third control state.

13. The input device of claim 9, wherein the first control state and the second control state each comprise a correlated color temperature (CCT) control state, a light intensity control state, or an "on" or "off" state of the lighting device.

14. The input device of claim 9, wherein the first selection mechanism comprises:

a switching mechanism; and a selection rod configured to receive the first input from a lens diffuser of the lighting device and to interact with the switching mechanism in response to the first input received from the lens diffuser.

15. A method, comprising:

receiving a first input from a first selection mechanism at a luminaire of a lighting system to transition from a first lighting control state to a second lighting control state;

receiving a second input from a rotational input mechanism at the luminaire of the lighting system to adjust a light output of the lighting system in the second lighting control state; and controlling a light intensity output or a correlated color temperature output of the lighting system using the second input from the rotational input mechanism, wherein receiving the first input from the first selection mechanism comprises detecting a depression of a lens diffuser of the lighting system, and wherein receiving the second input from the rotational input mechanism comprises detecting rotation of the lens diffuser.

16. The method of claim 15, further comprising:

receiving a third input from the first selection mechanism at the luminaire of the lighting system to transition from the second lighting control state to a third lighting control state;

receiving a fourth input from the rotational input mechanism at the luminaire of the lighting system to adjust a light output of the lighting system in the third lighting control state; and controlling the light intensity output or the correlated color temperature output of the lighting system using the fourth input from the rotational input mechanism.

17. The method of claim 16, wherein the second input from the rotational input mechanism controls the light intensity output while maintaining the correlated color temperature output of the lighting system, and wherein the fourth input from the rotational input mechanism controls the correlated color temperature output while maintaining the light intensity output of the lighting system.

* * * * *